United States Patent [19]

Swanson

[11] 3,957,503

[45] May 18, 1976

[54] EXTRACTION OF ZINC AND LEAD FROM THEIR SULFIDES

[76] Inventor: Rollan Swanson, 666 Salem Ave., Elizabeth, N.J. 07208

[22] Filed: May 6, 1974

[21] Appl. No.: 467,099

[52] U.S. Cl. ..... 75/77; 75/86; 423/562

[51] Int. Cl.[2] ..... C22B 13/00

[58] Field of Search ..... 75/77, 78, 86, 23, 14, 75/97 A, 120; 423/562

[56] References Cited

UNITED STATES PATENTS

| | | | |
|---|---|---|---|
| 1,025,956 | 5/1912 | Asbeck | 75/78 |
| 1,751,778 | 3/1930 | Girsewald et al. | 75/86 |
| 2,692,197 | 10/1954 | Denison | 75/78 |
| 3,663,207 | 5/1972 | Themelis | 75/23 |

FOREIGN PATENTS OR APPLICATIONS

| | | | |
|---|---|---|---|
| 161,778 | 7/1953 | Australia | 75/78 |
| 597,489 | 5/1960 | Canada | 75/78 |

*Primary Examiner*—M. J. Andrews
*Attorney, Agent, or Firm*—Albert F. Kronman

[57] ABSTRACT

Sulfidic ores of lead or zinc such as galena or sphalerite are smelted under vacuum in the absence of $CO_2$ and oxygen with a flux consisting of solid NaOH or KOH to free the lead or zinc as free metal and to form sodium or potassium disulfides which are used as flux in smelting additional sulfidic ores to liberate more metal and form still higher polysulfides of sodium or potassium also usable as flux up to the pentasulfide form. By the process of the invention, substantially complete use is made of the sulfur atoms initially combined with the lead or zinc to remove the sulfur combined with said metals. Potassium hydroxide, its lower sulfur content polysulfides can be reconstituted by exposing to air a leach solution of potassium pentasulfide.

11 Claims, No Drawings

EXTRACTION OF ZINC AND LEAD FROM THEIR SULFIDES

This invention is concerned with a process for separating zinc and lead from ore concentrates in which these metals are present in their sulfide form by using the sulfur atoms originally combined with the zinc or lead.

The main object of this invention is to improve the efficiency of processes for recovering these metals from their concentrates so as to reduce the overall cost of producing such metals and eliminate thermal and air pollution caused by prior art processes.

The process whereby the above object is attained comprises smelting the ore under vacuum in the absence of carbon dioxide and oxygen with a flux consisting of the tetrasulfides of potassium or sodium, initially prepared by reacting a portion of the ore with solid hydroxides of sodium and potassium, thereby liberating said lead and zinc in the free state and forming the pentasulfides of sodium or potassium, leaching the resulting slag with water to dissolve said pentasulfides and allowing the leach solution to contact air to form more hydroxide and lower sulfur content polysulfides for recycling.

A significant novel feature of the invention resides in the preparation of the higher sulfides of sodium and potassium by fusing zinc or lead sulfides with solid sodium or potassium hydroxides or polysulfides of sodium or potassium whereby use of the sulfur atoms in the original ore is made to liberate more metal.

Because the literature in this field indicated that these lead sulfides were not soluble in alkali hydroxides, the present invention is all the more unpredictable and unobvious, these sulfides having been found soluble in fused potassium and sodium hydroxides.

In the practice of the process of the invention, care must be exercised to exclude $O_2$, $CO_2$ and water from the reaction masses. Where water forms in any step of the process, it must be continuously removed. The presence of water or of oxygen in the system leads to the formation of oxides of zinc and lead and oxy compounds rather than of the free metals as shown in the following equation:

$$ZnS + 2\ KOH\ (\text{or } NaOH) = H_2O + ZnO + K_2S.$$

Water also causes the formation of hydrosulfides which decompose and of hydroxyl ions causing some free zinc or lead to dissolve and form plumbates or zincates. The presence of $CO_2$ is detrimental because it reduces the period of time during which the solution of the ore with the hydroxide flux remains liquid owing to the formation of carbonates which increase the melting point of the melt. This in turn prevents reactions from going to completeness.

The above outlined problems are avoided in accordance with the invention by dehydrating the ore prior to mixing it with the flux and by contacting the dehydrated ore with flux in the absence of air and $CO_2$.

The reactions are carried out in apparatus capable of removing carbon dioxide and oxygen from the reaction atmosphere. One type of vessel used was a pure iron or nickel crucible with screw-on air tight rings fastened to the outside upper surface of the vessel with the crucible screwed into an inverted funnel-shaped cover connected to a vacuum pump. Preferably, the pump should have a rating of around 98%. The screw-on connection operates by expansion of the rings when the bottom of the iron crucible is heated thereby giving an air-tight seal. The melt is stirred at 20–60 RPM by stirring means such as a stirrer.

After ceasing agitation, the temperature for the potassium melt is increased to 500° C. and the sodium melt temperature is increased to 550° C. The contents of the iron vessels containing the respective melts are transferred to a glass (transparent) vessel under vacuum conditions. Upon cooling, the metals (zinc or lead) are at the bottom (Sp. gr of zinc is 7.1 while the zinc oxide has a specific gravity of 5.6). The polysulfides formed are deposited in layers corresponding to their specific gravity, the higher sulfur content polysulfides are heavier and lie beneath the lower sulfur content polysulfides. The lead is equivalent in forming the separation layers but even more pronounced as both the oxide and metal have higher specific gravity than the corresponding zinc and zinc oxide. Some of the zinc will remain in the iron melt vessel, adhering firmly to the sides. The lead does not exhibit this property.

In the initial step (using the hydroxides of potassium and sodium) it is advisable to remove as great a quantity of the lead or zinc oxide formed in the layer above the respective metals, as is possible.

This can be done by physical means, at least for the greater quantity eliminating the necessity of −3 micron filtration (hot) at 500° C.), or by the alcohol or cold water washes, which dissolve the lower sulfur content polysulfides of sodium or potassium. If water is employed, in the potassium series (hydroxide or polysulfides), both the melt and the water must be cold.

The reactions on which the present process is based can be summarized as follows:

1. $2ZnS + 2KOH \xrightarrow{400°C} Zn + ZnO + K_2S_2 + H_2O$

| | | | | | | |
|---|---|---|---|---|---|---|
| Atomic Weight | 194.76 | 112.22 adjusted to 130.48 | 65.38 | 81.38 | 142.2 | 18 |
| | Totals | 306.9 | | | 306.9 | |

2. $2PbS + 2KOH \xrightarrow{400°C} Pb + PbO + K_2S_2 + H_2O$

| | | | | | | |
|---|---|---|---|---|---|---|
| Atomic Weight | 478.4 | 112.22 adjusted to 130.48 | 207.2 | 223.2 | 142.2 | 18 |
| | Totals | 590.62 | | | 590.62 | |

3. $2ZnS + 2NaOH \xrightarrow{400°C} Zn + ZnO + Na_2S_2 + H_2O$

| | | | | | | |
|---|---|---|---|---|---|---|
| Atomic Weight | 194.76 | 80 adjusted to 105.2 | 65.38 | 81.38 | 110 | 18 |
| | Totals | 274.76 | | | 274.76 | |

-continued

4. $2PbS + 2NaOH = Pb + PbO + Na_2S_2 + H_2O$

| | | | | | | |
|---|---|---|---|---|---|---|
| Atomic Weight | 478.4 | 80 adjusted to 105.2 | 207.2 | 223.2 | 110 | 18 |
| | Totals | 558.2 | | | 558.2 | |

The adjusted figures for the hydroxides represent a correction to the absolute purity.

The potassium disulfide formed is soluble in absolute ethyl alcohol. It was observed that some $K_2S_3$ and some $K_2S_4$ were formed. Some KOH remained and the over all empiric formula corresponds to $K_2S_2$.

The empirical formula $Na_2S_2$ represents a mix of NaOH, $Na_2S_2$, $Na_2S_3$, $Na_2S4$, and $Na_2S_5$. Some sulfur is also dissolved in the NaOH. The existence of the disulfide and trisulfide of sodium is problematical.

The sodium polysulfides are not as soluble as the potassium polysulfides in alcohol in the di- and tri-stages and water is used to dissolve the sodium polysulfides. Some sodium hydro-sulfide is formed when the water is added. Both the di-hydrate and trihydrate of sodium hydrosulfide are formed if the water is below 22°C.

The potassium disulfide in alcohol solution is filtered and evaporated to dryness. The sodium hydrosulfides are unstable at low temperatures and decompose. Accordingly, when the next step is performed the sodium hydrosulfide is not present.

The potassium disulfide is heated to above 470°C. in the iron vessel under the same reduced atmospheric pressure and the melting point is reached when it is mixed with additional zinc or lead sulfide.

| | | | | |
|---|---|---|---|---|
| 5. $K_2S_2 + ZnS = Zn + K_2S_3$ | | | | |
| Atomic Weight | 142.33 | 97.38 | 65.38 | 174.40 |
| | Totals | 239.7 | | 239.7 |
| 6. $K_2S_2 + 239.2 = Pb + K_2S_3$ | | | | |
| Atomic Weight | 142.33 | 239.2 | 207.2 | 174.40 |
| | Totals | 381.5 | | 381.6 |

The compound designated $Na_2S_2$ after being dried, is heated to 550°C. in an iron vessel under the 98% reduction of atmospheric pressure, when the melting point is reached it is mixed with additional zinc or lead sulfide.

| | | | | |
|---|---|---|---|---|
| 7. $Na_2S_2 + ZnS \rightarrow Zn + Na_2S_3$ | | | | |
| Atomic Weight | 144 | 97.38 | 65.38 | 176 |
| | Totals | 241.38 | | 241.38 |
| 8. $Na_2S_2 + PbS = Pb + Na_2S_3$ | | | | |
| Atomic Weight | 144 | 239.2 | 207.2 | 176 |
| | Totals | 393.2 | | 383.2 |

After ceasing stirring of the melt, the temperature is increased to above the melting point of zinc (419°C.) or the melting point of lead (325°C.). Cooling allows the polysulfides of both sodium and potassium to separate above the lead or zinc corresponding to their specific gravity. The lower sulfur content polysulfides settle at the top, the higher sulfur content polysulfides beneath them, the metals are on the bottom. The metals can be decanted from the polysulfides, however, some zinc will plate on iron vessels. No oxides are formed and the separation after step 1 (the hydroxides) are simple and physical.

The potassium trisulfide is soluble in absolute ethyl alcohol. The tetrasulfide is much less soluble. Complete washing with alcohol (until no further solids remain after the evaporation of the alcohol) permits a further water wash which dissolves the sparingly alcohol soluble pentasulfide. Some pentasulfide is formed apparently during the cooling of the melt.

The sodium trisulfide appears to contain a mixture of disulfide and pentasulfide, some tetrasulfide, sodium hydroxide and sulfur dissolved in the sodium hydroxide. The mixture is water soluble, the water is filtered and evaporated.

These trisulfides are now used to treat additional zinc and lead sulfides as shown:

| | | | | |
|---|---|---|---|---|
| 9. $K_2S_3 + ZnS = Zn + K_2S_4$ at above 252°C. | | | | |
| Atomic Weight | 174.4 | 97.38 | 65.38 | 206.4 |
| | Totals | 271.7 | | 271.7 |
| 10. $K_2S_3 + PbS = Pb + K_2S_4$ | | | | |
| Atomic Weight | 174.4 | 239.2 | 207.2 | 206.4 |
| | Totals | 413.6 | | 413.6 |
| 11. $Na_2S_3 + ZnS = Zn + Ns_2S_4$ at 345°C. | | | | |
| Atomic Weight | 142 | 97.38 | 65.38 | 174 |
| | Totals | 239.38 | | 239.38 |
| 12. $Na_2S_3 + PbS = Pb + Na_2S_4$ | | | | |
| Atomic Weight | 142 | 381.2 | 207.2 | 174 |
| | Totals | 381.2 | | 381.2 |

After ceasing agitation of the melt, the temperature is increased to 325°C. for the potassium, and the liquid polysulfides can be poured off the zinc which is not melted at this temperature lead can similarly be treated at slightly less temperature (320°C.). It is advisable, after ceasing the stirring to increase the temperature briefly to reach the melting point of zinc or lead in order to have a button or one solid piece of metal which when cooled to 325°–320°C. makes for an easy separation of the metals from the polysulfides.

The potassium tetrasulfide is much less soluble in the absolute alcohol than the potassium trisulfide. The alcohol wash can be used however. Many repeat washings are necessary to extract all the alcohol soluble ingredients. Some pentasulfide is formed (the decomposition point of the pentasulfide is 300°C. and this extraction is carried out below this temperture). The pentasulfide is only sparingly ethyl alcohol soluble. Water can be used as the solvent, however, the water should be cold, trisulfide decomposes in hot water, and must be free of oxygen and carbon dioxide. The water solution is filtered and evaporated to dryness. The substances which remain are either hygroscopic or deliquescent and heat must be used to attain dryness. The heat used should be below 300°C.

The sodium tetrasulfide formed is more uniform and stable than the previous polysulfide forms. Again cold water is used to dissolve the polysulfide and the solution is evaporated to dryness.

The solution is evaporated to dryness to recover the tetrasulfides of sodium or potassium while the zinc or lead is recovered by filtration (prior to letting solution stand in air for evaportion).

These tetrasulfides are used to treat further quantities of zinc and lead sulfides; the potassium at 210°C; the sodium at 280°C. as shown by the following equations:

| | | | | |
|---|---|---|---|---|
| 13. $K_2S_4 + ZnS = Zn + K_2S_5$ | | | | |
| Atomic Weight | 206.4 | 97.38 | 65.38 | 238.4 |
| | Totals | 303.8 | | 303.8 |
| 14. $K_2S_4 + PbS = Pb + K_2S_5$ | | | | |
| Atomic Weight | 206.4 | 239.2 | 207.2 | 238.4 |
| | Totals | 445.6 | | 445.6 |
| 15. $Na_2S_4 + ZnS = Zn + Na_2S_5$ | | | | |
| Atomic Weight | 174 | 97.38 | 65.38 | 206 |
| | Totals | 271.38 | | 271.38 |
| 16. $Na_2S_4 + PbS = Pb + Na_2S_5$ | | | | |
| Atomic Weight | 174 | 239.2 | 207.2 | 206 |
| | Totals | 413.2 | | 413.2 |

The pentasulfides formed in equations 15 and 16 are leached with water. The aqueous leach solution is then left exposed to air for 8 hours to reconstitute the sodium or potassium hydroxide.

It should be noted from the above that lead and zinc are formed and recovered at each step by the process thereby improving yields to around 99% basis starting sulfidic ore concentrate with the first two equations yielding about 50% of the ore as free metal The potassium and sodium hydroxides used are reagent grade.

The tetrasulfides of potassium are stable to 800°C. and the sodium tetrasulfides are less stable but can be heated to 420°C. The melting point of the tetrasulfide of potassium is 135°C. and for sodium tetrasulfide the melting point is 275°C. Decomposition sets in just above this temperature, and must be carefully reached in the case of sodium. With the potassium tetrasulfide at low tempertures above 135°C. the additional zinc or lead sulfide is reduced to metals at these low temperatures with the formation of the pentasulfide. The pentasulfide is liquid at 206°C. but decomposes at 300°C. Thus to keep the melt liquid, a temperature of over 206C. but below 300°C. is necessary. After the reduction of the zinc or lead to the metallic state, if the temperature is increased to the melting point of zinc (419°C.) the polysulfides break down to essentially tetrasulfide (stable to 800°C.) while the zinc or lead is collected at the bottom. In the vacuum conditions of the melt, the sulfur can not burn and seems to both dissolve in the polysulfides and to come off as molten sulfur, specific gravity 2.07 in the layer between the cooled polysulfides and the metals. If the temperature is increased to 445°C. most of the sulfur is physically removable between the polysulfide layers and the metal layer at the bottom. The recovered essentially tetrasulfide can be recycled with more zinc or lead sulfide at this step. The sodium is not satisfactory at this step, in regards to recycling or sulfur separation.

The invention is further illustrated by the following specific examples, but it will be understood that the invention is not limited thereto. The parts given are by weight unless volumes of liquid are specified.

EXAMPLE I 194.76 parts of ZnS were preheated to substantially dehydrate same. 130.48 parts of potassium hydroxide were heated to the fusing temperature of around 400°C. in an iron fusion pot of the type above described under a vacuum of 98%. When the KOH was completely melted, one third of the ZnS was added in less than 5 minutes and the temperature was reduced to about 310°C. Another one-third of the ZnS was added and the temperature was reduced to 275°C. and the remainder of the ZnS was added. The melt turned yellow indicating the presence of $K_2S_2$. This compound was recovered by repeatedly extracting the cooled melt with 400 ml portions of absolute ethanol thereby giving 142.2 parts of $K_2S_2$ Zn metal (65.38 parts) were separated physically and by cold filtration. This amount of $K_2S_2$ was then heated to above 470°C. in the same vessel under the same conditions as before. When the $K_2S_2$ flux melted, 97.38 parts of ZnS were added and mixed therewith. The melt turned brown yellow indicating the presence of $K_2S_3$; 174.40 parts of $K_2S_3$ were collected by extracting with 500 ml portions of absolute ethanol and 65.38 of zinc metal were collected by filtration. Next, 174.40 parts of $K_2S_3$ were heated to above 252°C. in the same apparatus under the same conditions and 97.3 parts of ZnS added thereto. The melt turned brown red indicating the formation of $K_2S_4$. This material (206.4 parts) was extracted with absolute ethanol; 65.38 parts of Zn metal were recovered, 206.4 parts of $K_2S_4$ were heated as before to 210°C. and 97.38 parts of ZnS were mixed therewith to give a melt which was orange indicating the presence of $K_2S_5$; 238.4 parts of $K_2S_5$ were extracted with successive portions of 100 ml of water. The resulting solution was left in the open air for 8 hours and 85% KOH were recovered by distilling the water; 65.38 parts of zinc metal were recovered by filtration.

EXAMPLE II 478.4 parts of PbS were preheated to substantially dehydrate same; 105.2 parts of NaOH were heated to the fusion temperature of around 400°C. in an iron fusion pot of the type above described under a vacuum of 98%. When the NaOH was completely melted, one third of the PbS was added in less than 5 minutes and the temperature was reduced to about 310°C. Another one-third of the PbS was added and the temperature was reduced to 275°C. and the remainder of the PbS was added. $Na_2S_2$ was recovered by repeatedly extracting the cooled melt with 400 ml. portions of absolute ethanol thereby giving 100 parts of $Na_2S_2$. Lead metal (207.2 parts) was separated by filtering and decanting. This amount of $Na_2S_2$ was then heated to above 470°C. in the same vessel under the same conditions as before. When the $Na_2S_2$ flux melted, 239.2 parts of PbS were added and mixed therewith; 176 parts of $Na_2S_3$ were collected by extracting with 500 ml. portions of absolute ethanol and 207.2 parts lead metal were collected by filtration. Next, 142 parts of $Na_2S_3$ were heated to above melting and 381.2 parts of lead sulfide added to form $Na_2S_4$; 174 parts of $Na_2S_4$ were heated as before to 210 °C. and 239.2 parts of PbS were mixed therewith to give a melt containing $Na_2S_5$. 206 parts of $Na_2S_5$ were extracted with successive portions of 100 ml. of water. The resulting solution was left in the open air for 8 hours and 85% NaOH was recovered distilling the water; 207 parts of lead metal were recovered by filtration.

After the hydroxide treatment, above, whereby the melt cools in layers corresponding to the respective specific gravities, and where the oxide of lead and zinc are formed, the further separations of the polysulfides from the metals can be carried out by simple decanting. When the final (pentasulfide) stage is reached, use is made of the melting points and decomposition points of the tetrasulfide and pentasulfide so as to reconstitute essentially the tetrasulfide. (This recycling of the material is applicable to potassium.)

What is claimed is:

1. A process for extracting zinc and/or lead from a sulfidic ore thereof, comprising smelting said ore under vacuum in the absence of water, $CO_2$ and oxygen with a flux consisting of the tetrasulfide of sodium or potassium thereby liberating said zinc and/or lead in the free state and forming the pentasulfides of said potassium or sodium and separating the zinc and/or lead from the pentasulfide.

2. The process of claim 1 wherein said smelting is carried out with potassium tetrasulfide and further including the step of thermally decomposing the separated potassium pentasulfide to potassium tetrasulfide and recycling same.

3. The process of claim 1, wherein said smelting is carried out with potassium tetrasulfide at a temperature in the range of over 206°C. but below 300°C.

4. A process for extracting zinc and/or lead from a sulfidic ore thereof, comprising:

A. smelting said ore under vacuum in the absence of water, carbon dioxide and oxygen by intimately mixing said ore with a flux consisting of fused sodium or potassium hydroxide to form lead and/or zinc metal, lead and/or zinc oxide and the disulfide of sodium or potassium;

B. separating said metal from said disulfide;

C. smelting additional amounts of said sulfidic ore under the above stated conditions of the first step but using a flux consisting of the separated disulfide to form additional metal and the trisulfide of sodium or potassium;

D. separating said additional metal from said trisulfide;

E. smelting further amounts of said sulfidic ore under the above stated conditions of the first step but using a flux consisting of the separated trisulfide to form further metal and the tetrasulfide of sodium or potassium;

F. separating said further metal and said tetrasulfide;

G. smelting more of said sulfidic ore under the above stated conditions of the first step but using a flux consisting of the separated tetrasulfide to form more metal and the pentasulfide of sodium or potassium;

H. separating said last formed metal and said pentasulfide.

5. The process of claim 4, further including the step of dehydrating said ore.

6. The process of claim 4, wherein the separation of step H comprises heating the last formed metal and said pentasulfide under vacuum and in the absence of carbon dioxide, water and oxygen whereby the pentasulfide forms the tetrasulfide and sulfur, and said sulfur is recoverable as a layer between the tetrasulfide and last formed metal upon cooling.

7. The process of claim 4, wherein zinc and/or lead sulfide is present in an excess over said hydroxide.

8. The process according to claim 4, wherein lead is formed and said lead is separated from the polysulfides of sodium or potassium by heating the melt to about 320°C. and pouring out the melted polysulfides, leaving behind said lead.

9. The process of claim 4, wherein zinc is formed and said zinc is separated from the polysulfides of sodium or potassium by heating the melt to around 325°C. and pouring out the melted polysulfides leaving behind said zinc.

10. The process of claim 4, wherein said ores are galena or sphalerite.

11. The process according to claim 4, wherein said mixing of step (A) comprises completely melting said hydroxide, adding about one third of the stoichiometric amount of said sulfidic ore, reducing the temperature of the resulting melt, adding about another third of said amount of said ore, further reducing the temperature and adding the rest of said ore.

* * * * *